US008605122B2

(12) United States Patent
Weng

(10) Patent No.: US 8,605,122 B2
(45) **Date of Patent: *Dec. 10, 2013**

(54) GAMMA VOLTAGE GENERATION CIRCUIT

(75) Inventor: Meng-Tse Weng, Tainan County (TW)

(73) Assignee: Himax Technologies Limited, Tainan (TW)

( * ) Notice: Subject to any disclaimer, the term of this patent is extended or adjusted under 35 U.S.C. 154(b) by 840 days.

This patent is subject to a terminal disclaimer.

(21) Appl. No.: 12/689,459

(22) Filed: Jan. 19, 2010

(65) Prior Publication Data

US 2011/0175937 A1 Jul. 21, 2011

(51) Int. Cl.
*G09G 5/10* (2006.01)

(52) U.S. Cl.
USPC ..... 345/690; 345/211

(58) Field of Classification Search
USPC ..... 345/87–89, 91, 99, 211, 121, 690
See application file for complete search history.

(56) References Cited

U.S. PATENT DOCUMENTS

| | | | | |
|---|---|---|---|---|
| 7,973,690 | B1 * | 7/2011 | Weng | 341/144 |
| 2005/0057482 | A1 | 3/2005 | Youngblood et al. | |
| 2006/0267672 | A1 * | 11/2006 | Huang | 327/538 |
| 2008/0007503 | A1 | 1/2008 | Chiou | |
| 2009/0135116 | A1 | 5/2009 | Chang | |
| 2010/0207967 | A1 * | 8/2010 | Baek et al. | 345/690 |
| 2011/0012882 | A1 * | 1/2011 | Jeong et al. | 345/211 |
| 2011/0169544 | A1 * | 7/2011 | Weng | 327/333 |
| 2011/0175663 | A1 * | 7/2011 | Weng | 327/333 |
| 2011/0175877 | A1 * | 7/2011 | Weng | 345/211 |

FOREIGN PATENT DOCUMENTS

| | | |
|---|---|---|
| TW | 200735026 | 9/2007 |
| TW | 200926136 | 6/2009 |

OTHER PUBLICATIONS

"Office Action of Taiwan Counterpart Application", issued on Mar. 22, 2013, p. 1-p. 8, in which the listed references were cited.

* cited by examiner

*Primary Examiner* — Ricardo L Osorio
(74) *Attorney, Agent, or Firm* — J.C. Patents

(57) ABSTRACT

A gamma voltage generation circuit is provided. The gamma voltage generation circuit includes a plurality of resistor strings, a plurality of second resistors and a plurality of switches. Each of the resistor strings has a plurality of first resistors connected in series. Each of ends of the first resistors provides a gamma reference voltage. Each of second resistors is connected in series with the resistor strings. Each of the switches is coupled to a corresponding one of the resistor strings, selects and outputs one of the gamma reference voltages provided by the ends of the first resistors of the corresponding one of the resistor strings according to a control signal. Therefore, levels of the gamma voltages can synchronously displaced, so that the effects presented by pixels with different common voltage levels are similar or equal.

7 Claims, 4 Drawing Sheets

GAMMA VOLTAGE GENERATION CIRCUIT

BACKGROUND OF THE INVENTION

1. Field of the Invention

The present invention relates to a gamma voltage generation circuit. More particularly, the present invention relates to a gamma voltage generation circuit which can adjust voltage levels of output gamma voltages.

2. Description of Related Art

In a present information society, as information communication media and various electronic display devices are widely used in industrial apparatus or home appliances, the electronic display devices become indispensable, and the electronic display devices are continually updated to meet various demands of the information society.

Generally, the electronic display device displays and transmits various information to users. Namely, the electronic device can convert electronic information signals into optical information signals that can be visually recognized by the user.

In a present display device or a system, for example, a cathode-ray tube (CRT) or a liquid crystal display (LCD), a relationship between an input voltage and a display output thereof is not linear, and the relationship between the input voltage and the display output can be described by a gamma curve. Regarding the LCD, an output voltage (i.e. a gamma voltage) corresponding to each of gray levels can be found according to the gamma curve, and by outputting the corresponding gamma voltage, a LCD panel thereof can display a correct gray level, so that the LCD can correctly display images.

To improve a display effect of the LCD, some of the LCD panels can divide a single pixel into two sub pixels. Common voltage levels of the two sub pixels are probably different due to a design of a circuit structure. In this case, when a same gamma voltage is output to the LCD panel, display effects (for example, brightness) of the two sub pixels can be different, so that a display quality thereof is influenced. Therefore, to make different sub pixels to present a same display effect, levels of the output gamma voltages are probably different. Namely, when some of the pixels present the same display effect, displaced gamma voltages have to be received.

FIG. 1 is a circuit schematic diagram illustrating a conventional gamma voltage generation circuit. Referring to FIG. 1, a voltage between a level voltage GMAH and a level voltage BGMAL can be divided by resistors CR0-CR64 to output gamma reference voltages CV0-CV63, wherein the gamma reference voltage CV1 is equal to a level voltage AGMAL, and the level voltage AGMAL is higher than the level voltage BGMAL. Switches 110_1-110_64 select to output the gamma reference voltages CV0-CV63 to serve as gamma voltages V0-V63, or output the gamma reference voltages CV1-CV64 to serve as the gamma voltages V0-V63 according to a control signal S1. A digital-to-analog converter (DAC) 130 selects to output one of the gamma voltages V0-V63 to serve as a driving voltage. However, since resistances of the resistors CR0-CR64 are different, a voltage difference between the gamma reference voltage CV0 and the gamma reference voltage CV1 is different to a voltage difference between the gamma reference voltage CV1 and the gamma reference voltage CV2. Therefore, a display effect of a gray level in case that the gamma reference voltages CV0-CV63 are taken as the gamma voltages V0-V63 is different to a display effect of the same gray level in case that the gamma reference voltages CV1-CV64 are taken as the gamma voltages V0-V63.

SUMMARY OF THE INVENTION

The present invention is directed to a gamma voltage generation circuit, which can synchronously displace output gamma voltages.

The present invention provides a gamma voltage generation circuit including a plurality of resistor strings, a plurality of second resistors and a plurality of switches. Each of the resistor strings has a plurality of first resistors connected in series, and each of ends of the first resistors provides a gamma reference voltage. The second resistors are connected in series with the resistor strings. Each of the switches is coupled to a corresponding one of the resistor strings, and selects and outputs one of the gamma reference voltages provided by the ends of the first resistors of the corresponding one of the resistor strings according to a control signal.

In an embodiment of the present invention, each of the second resistors is connected between two of the resistor strings.

In an embodiment of the present invention, each of the switches is controlled by the control signal to be selectively connected to one of the ends of the first resistors of the corresponding one of the resistor strings.

In an embodiment of the present invention, the resistances of the second resistors are different from each other.

In an embodiment of the present invention, the gamma voltage generation circuit further includes a digital-to-analog converter (DAC), wherein the DAC outputs one of the gamma reference voltages selected by the switches according to a display code.

In an embodiment of the present invention, a first end of a first one of the resistor strings is applied with a first reference voltage, a last end of a last one of the resistor strings is applied with a second reference voltage, and the first reference voltage is greater than the second reference voltage.

In an embodiment of the present invention, each of the gamma reference voltages provided by the ends of the first resistors is equal to or less than the first reference voltage, and each of the gamma reference voltages provided by the ends of the first resistors is equal to or greater than the second reference voltage.

The gamma voltage generation circuit of the present invention can selectively output a part of the gamma reference voltages to serve as the gamma voltages according to the control signal, and voltage differences of the output gamma voltages are maintained fixed, so that the levels of the gamma voltages can be synchronously displaced. Therefore, according to the synchronous displacement of the gamma voltages, pixels of different common voltage levels can present a same or similar display effect.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

First Embodiment

Figure 2:
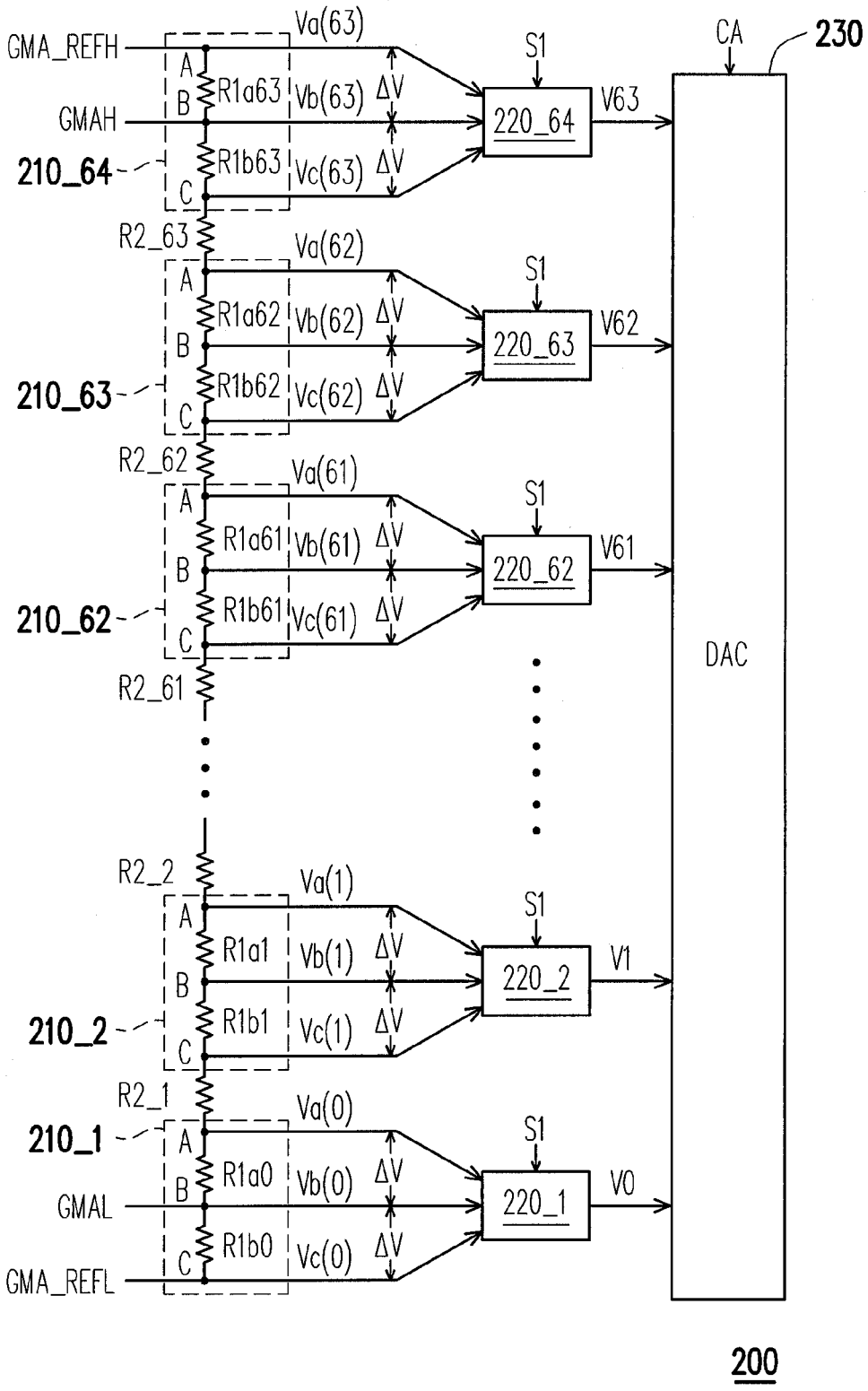
FIG. 2 is a circuit diagram illustrating a gamma voltage generation circuit according to a first embodiment of the present invention.

FIG. 2 is a circuit diagram illustrating a gamma voltage generation circuit according to a first embodiment of the present invention. Referring to FIG. 2, the gamma voltage generation circuit 200 includes resistor strings 210_1-210_64, second resistors R2_1-R2_63, switches 220_1-220_64, and a digital-to-analog converter (DAC) 230. Each of the resistor strings 210_1-210_64 has two first resistors (R1*a*0, R1*b*0), (R1*a*1, R1*b*1), . . . or (R1*a*63, R1*b*63) connected in series. The second resistors R2_1-R2_63 are respectively connected between the resistor strings 210_1-210_64 in series, i.e. the second resistor R2_63 is connected between the resistor strings 210_64 and 210_63 in series, and the second resistor R2_62 is connected between the resistor strings 210_63 and 210_62 in series, and the others are deduced by analogy. In an embodiment of the present invention, the sum of the resistances of the resistors R1*b*63, R2_63 and R1*a*62 is equal to the resistance of the resistor CR63, the sum of the resistances of the resistors R1*b*62, R2_62 and R1*a*61 is equal to the resistance of the resistor CR62, . . . , and the sum of the resistances of the resistors R1*b*1, R2_1 and R1*a*0 is equal to the resistance of the resistor CR1.

A first end of the resistor string 210_64 receives a first reference voltage GMA_REFH, and a second end B of the resistor sting 210_64 receives a first level voltage GMAH, wherein the first reference voltage GMA_REFH and the first level voltage GMAH have a voltage difference of a displacement voltage ΔV. A third end C of the resistor string 210_1 receives a second reference voltage GMA_REFL, and the second terminal B of the resistor string 210_1 receives a second level voltage GMAL, wherein the second reference voltage GMA_REFL and the second level voltage GMAL have a voltage difference of the displacement voltage ΔV. Moreover, the first reference voltage GMA_REFH is greater than the second reference voltage GMA_REFL.

The first resistors (R1*a*0, R1*b*0), (R1*a*1, R1*b*1), . . . and (R1*a*63, R1*b*63) of the resistor strings 210_1-210_64 and the second resistors R2_1-R2_63 divides a voltage between the first reference voltage GMA_REFH and the second reference voltage GMA_REFL, and the divided voltages are output to serve as gamma reference voltages (i.e. Va(63), Vb(63), Vc(63), Va(62), Vb(62), Vc(62), . . . , Va(0), Vb(0), Vc(0)), wherein the gamma reference voltage Vb(63) is equal to the first level voltage GMAH, and the gamma reference voltage Vb(0) is equal to the second level voltage GMAL. Moreover, the gamma reference voltages Va(63), Vb(63), Vc(63), Va(62), . . . , Va(0), Vb(0), and Vc(0) are equal to or less than the first reference voltage GMA_REFH, and the gamma reference voltages Va(63), Vb(63), Vc(63), Va(62), . . . , Va(0), Vb(0), and Vc(0) are equal to or greater than the second reference voltages GMA_REFL.

A voltage drop between two ends of each of the first resistors R1*a*0-R1*a*63 and R1*b*0-R1*b*63 is substantially equal to the displacement voltage ΔV. Moreover, a voltage difference between ends of two adjacent resistor strings that marked with same reference numerals is equal to a voltage difference between the gamma voltages corresponding to the two adjacent resistor strings. For example, a voltage difference between the second end B of the resistor string 210_64 and the second end B of the resistor string 210_63 is equal to a voltage difference between the gamma voltages V64 and V63, and a voltage difference between the second end B of the resistor string 210_63 and the second end B of the resistor string 210_62 is equal to a voltage difference between the gamma voltages V63 and V62. Moreover, since voltage differences of the gamma voltages V0-V64 output by each two adjacent switches of the switches 220_1-220_64 are probably different, the resistors R2_1-R2_63 can respectively use the same of different resistances according to the corresponding different voltage differences.

The switches 220_1-220_64 are respectively coupled to the corresponding resistor strings 210_1-210_64, and synchronously select and output one of the gamma reference voltages provided by the ends of the first resistors R1*a*0-R1*a*63 and R1*b*0-R1*b*63 of the corresponding resistor strings according to a control signal S1. For example, when the switch 220_64 is coupled to the end A of the resistor string 210_64 according to the control signal S1, the switch 220_64 outputs the gamma reference voltage Va(63) to serve as the gamma voltage V63. Meanwhile, the switches 220_63-220_1 are also respectively coupled to the ends A of the resistors strings 210_63-210_1 according to the control signal S1, and output the gamma reference voltages Va(62)-Va(0) to serve as the gamma voltages V62-V0.

When the switch 220_64 is coupled to the end B of the resistor string 210_64 according to the control signal S1, the switch 220_64 outputs the gamma reference voltage Vb(63) to serve as the gamma voltage V63. Meanwhile, the switches 220_63-220_1 are also respectively coupled to the ends B of the resistors strings 210_63-210_1 according to the control signal S1, and output the gamma reference voltages Vb(62)-Vb(0) to serve as the gamma voltages V62-V0. Similarly, the switches 220_64-220_1 can also be respectively coupled to the ends C of the resistors strings 210_64-210_1 according to the control signal S1, and output the gamma reference voltages Vc(63)-Vc(0) to serve as the gamma voltages V63-V0.

If the gamma reference voltages Vb(63), Vb(62), . . . , Vb(1) and Vb(0) are taken as standard gamma voltages, the gamma reference voltages Vc(63), Vc(62), . . . , Vc(1) and Vc(0) are the gamma voltages displaced downwards for one displacement voltage ΔV, and the gamma reference voltages Va(63), Va(62), . . . , Va(1) and Va(0) are the gamma voltages displaced upwards for one displacement voltage ΔV. Relationships between the gamma reference voltages can be represented by following equations:

$$Va(n)=Vb(n)+\Delta V$$

$$Vc(n)=Vb(n)-\Delta V$$

Where n is an integer, and $63 \geq n \geq 0$.

Accordingly, the switches 220_1-220_64 can be synchronously coupled to the ends A, ends B or ends C of the resistor strings 210_1-210_64 according to the control signal S1, so as to adjust the levels of the gamma voltages V63, V62, . . . , V1 and V0. Therefore, the gamma voltage generation circuit 200 provides three gamma curves, first one of which provides the gamma voltages Va(0)-Va(63), the second one provides the gamma voltages Vb(0)-Vb(63), and the third one provides the gamma voltages Vc(0)-Vc(63). In addition, when the level of the common voltages of different pixels (or sub-pixel) is different, the reference voltages of different levels can be outputted to tune the level of respective gamma voltages according to the control signal S1 so as to make the illumination of different pixels close or even the same for the same grey level. The phenomenon of color shift of the LCD panel would be avoided by applying proper gamma voltages to the subpixels of the LCD panel. For example, in an LCD panel that one pixel thereof has two sub-pixels applied by different common voltages, when driving the two sub-pixels of the same pixel, one of the sub-pixels may be driven by using one of the three gamma curves, and the other sub-pixel may be driven by using another one of the three gamma curves, such that the phenomenon of color shift of the LCD panel would be avoided.

Figure 1:
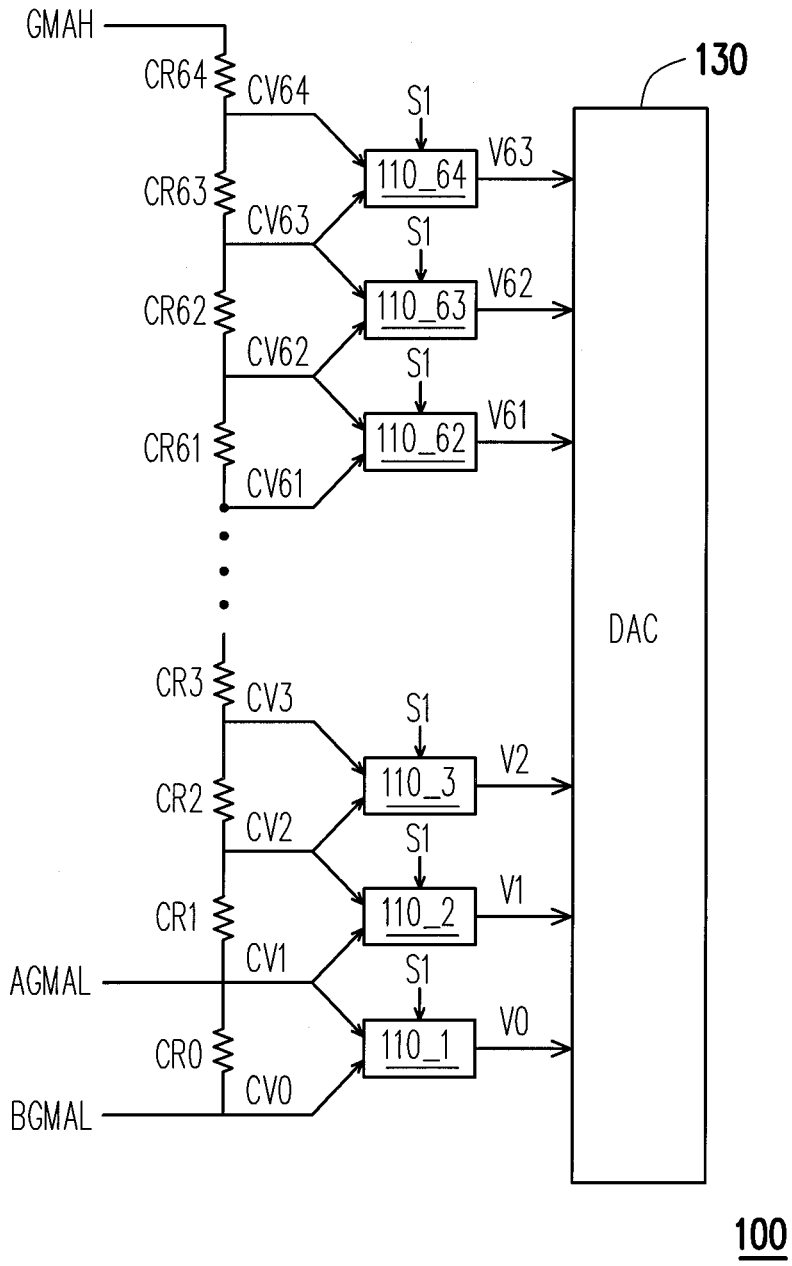
FIG. 1 (RELATED ART)
FIG. 1 is a circuit schematic diagram illustrating a conventional gamma voltage generation circuit.

The DAC 230 outputs one of the gamma voltages V63-V0 output by the switches 220_1-220_64 to serve as a driving voltage according to a display code CA, so as to drive a liquid crystal panel to display a brightness of a gray level corresponding to the display code CA. By such means, when levels of common voltages of two sub pixels of a single pixel (or two pixels) are different, the levels of the gamma voltages can be adjusted according to the control signal S1, so that the two sub pixels can display similar or the same brightness corresponding to the same gray level. It should be noticed that FIG. 1 illustrates a gamma voltage generation circuit of 6 bits (i.e. the number of the switches and the number of the second resistors are 6 power of 2), and if a gamma voltage generation circuit of 8 bits is used, the number of the resistor strings and the number of the switches are increased to 256 (i.e. 8 power of 2), and the number of the second resistors is increased to 255. The gamma voltage generation circuits of other number of bits (for example, 10 bits) can be deduced by analogy.

Second Embodiment

Figure 3:
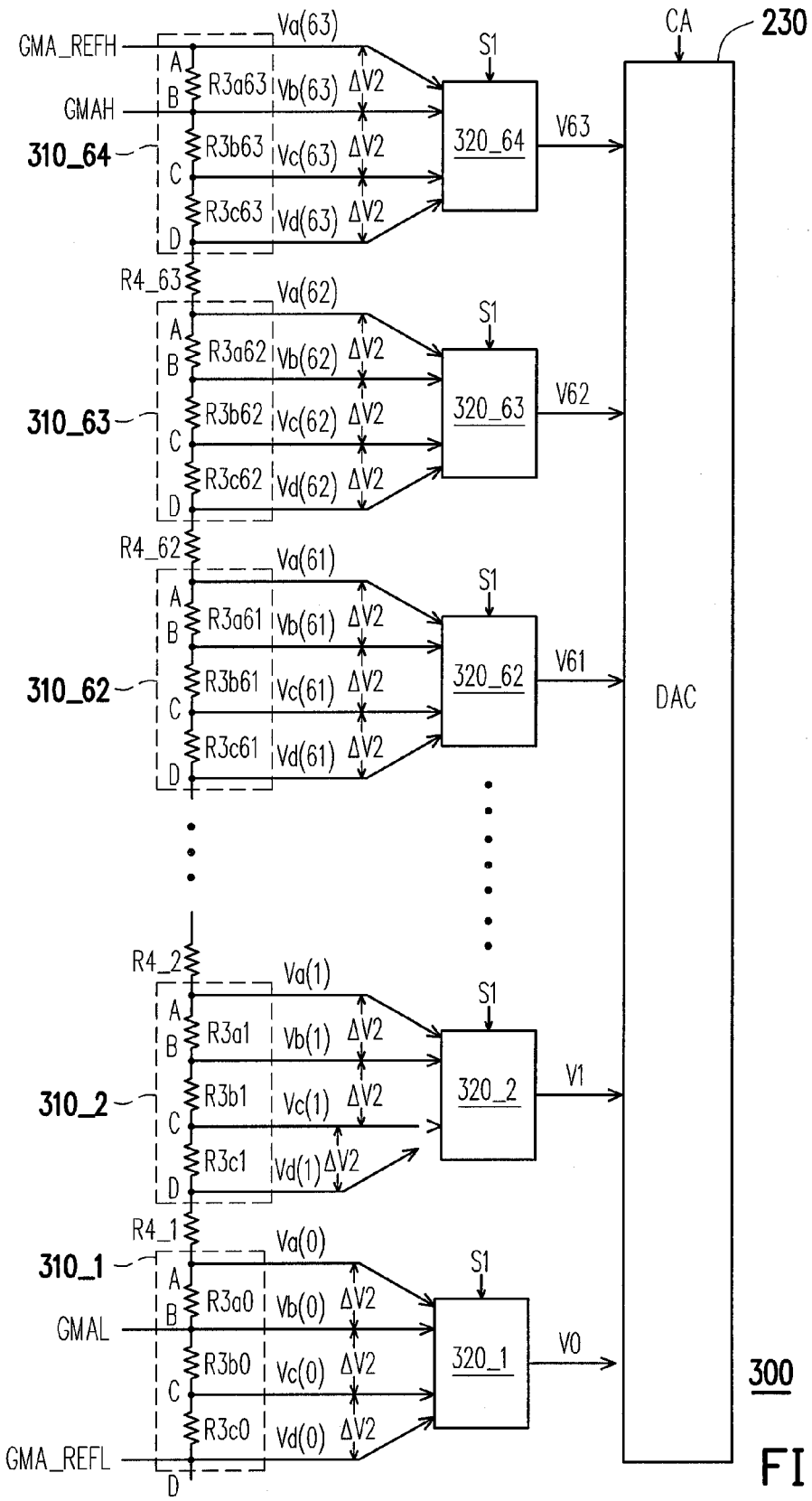
FIG. 3 is a circuit diagram illustrating a gamma voltage generation circuit according to a second embodiment of the present invention.

FIG. 3 is a circuit diagram illustrating a gamma voltage generation circuit according to a second embodiment of the present invention. Referring to FIG. 2 and FIG. 3, differences there between lie in resistor strings 310_1-310_64 and switches 320_1-320_64 of the gamma voltage generation circuit 300. The resistor strings 310_1-310_64 respectively have three first resistors (R3*a*0, R3*b*0, R3*c*0), (R3*a*1, R3*b*1, R3*c*1), . . . or (R3*a*63, R3*b*63, R3*c*63). A voltage drop between two ends of each of the first resistors R3*a*0-R3*a*63, R3*b*0-R3*b*63 and R3*c*0-R3*c*63 is substantially equal to a displacement voltage ΔV2. Each of the switches 320_1-320_64 is coupled to one of the ends A-D of a corresponding one of the resistor strings 310_1-310_64 according to the control signal S1, so as to respectively output gamma reference voltages Va(63)-Va(0), Vb(63)-Vb(0), Vc(63)-Vc(0) or Vd(63)-Vd(0) to serve as the gamma voltages V63-V0, which is similar to that of the first embodiment, and detailed descriptions thereof are not repeated. In an embodiment of the present invention, the sum of the resistances of the resistors R3*b*63, R3*c*63, R4_63 and R3*a*62 is equal to the resistance of the resistor CR63, the sum of the resistances of the resistors R3*b*62, R3*c*62, R4_62 and R3*a*61 is equal to the resistance of the resistor CR62, . . . , and the sum of the resistances of the resistors R3*b*1, R3*c*1, R4_1 and R3*a*0 is equal to the resistance of the resistor CR1.

If the gamma reference voltages Vb(63), Vb(62), . . . , Vb(1) and Vb(0) are taken as standard gamma voltages, the gamma reference voltages Vc(63), Vc(62), . . . , Vc(1) and Vc(0) are the gamma voltages displaced downwards for one displacement voltage ΔV2, the gamma reference voltages Vd(63), Vd(62), . . . , Vd(1) and Vd(0) are the gamma voltages displaced downwards for two displacement voltage ΔV2, and the gamma reference voltages Va(63), Va(62), . . . , Va(1) and Va(0) are the gamma voltages displaced upwards for one displacement voltage ΔV. Relationships between the gamma reference voltages can be represented by following equations:

$$Va(n)=Vb(n)+\Delta V2$$

$$Vc(n)=Vb(n)-\Delta V2$$

$$Vd(n)=Vb(n)-2\Delta V2$$

Where n is an integer, and 63≥n≥0.

Accordingly, the switches 320_1-320_64 can be synchronously coupled to the ends A, ends B, ends C or ends D of the resistor strings 310_1-310_64 according to the control signal S1, so as to adjust the levels of the gamma voltages V63, V62, . . . , V1 and V0. Therefore, the gamma voltage generation circuit 200 provides four gamma curves, first one of which provides the gamma voltages Va(0)-Va(63), the second one provides the gamma voltages Vb(0)-Vb(63), the third one provides the gamma voltages Vc(0)-Vc(63), and the fourth one provides the gamma voltages Vd(0)-Vd(63). In addition, when the level of the common voltages of different pixels (or sub-pixel) is different, the reference voltages of different levels can be outputted to tune the level of respective gamma voltages according to the control signal S1 so as to make the illumination of different pixels close or even the same for the same grey level. The phenomenon of color shift of the LCD panel would be avoided by applying proper gamma voltages to the subpixels of the LCD panel. For example, in an LCD panel that one pixel thereof has two sub-pixels applied by different common voltages, when driving the two sub-pixels of the same pixel, one of the sub-pixels may be driven by using one of the three gamma curves, and the other sub-pixel may be driven by using another one of the three gamma curves, such that the phenomenon of color shift of the LCD panel would be avoided.

It should be noticed that since the number of the resistors of the resistor string is different to that of the resistor string of the first embodiment, the resistances of the second resistors R4_1-R4_63 can be the same or different to that of the second resistors R2_1-R2_63 according to a design requirement. Moreover, the displacement voltage ΔV2 can also be the same or different to the displacement voltage ΔV according to actual application conditions.

Third Embodiment

Figure 4:
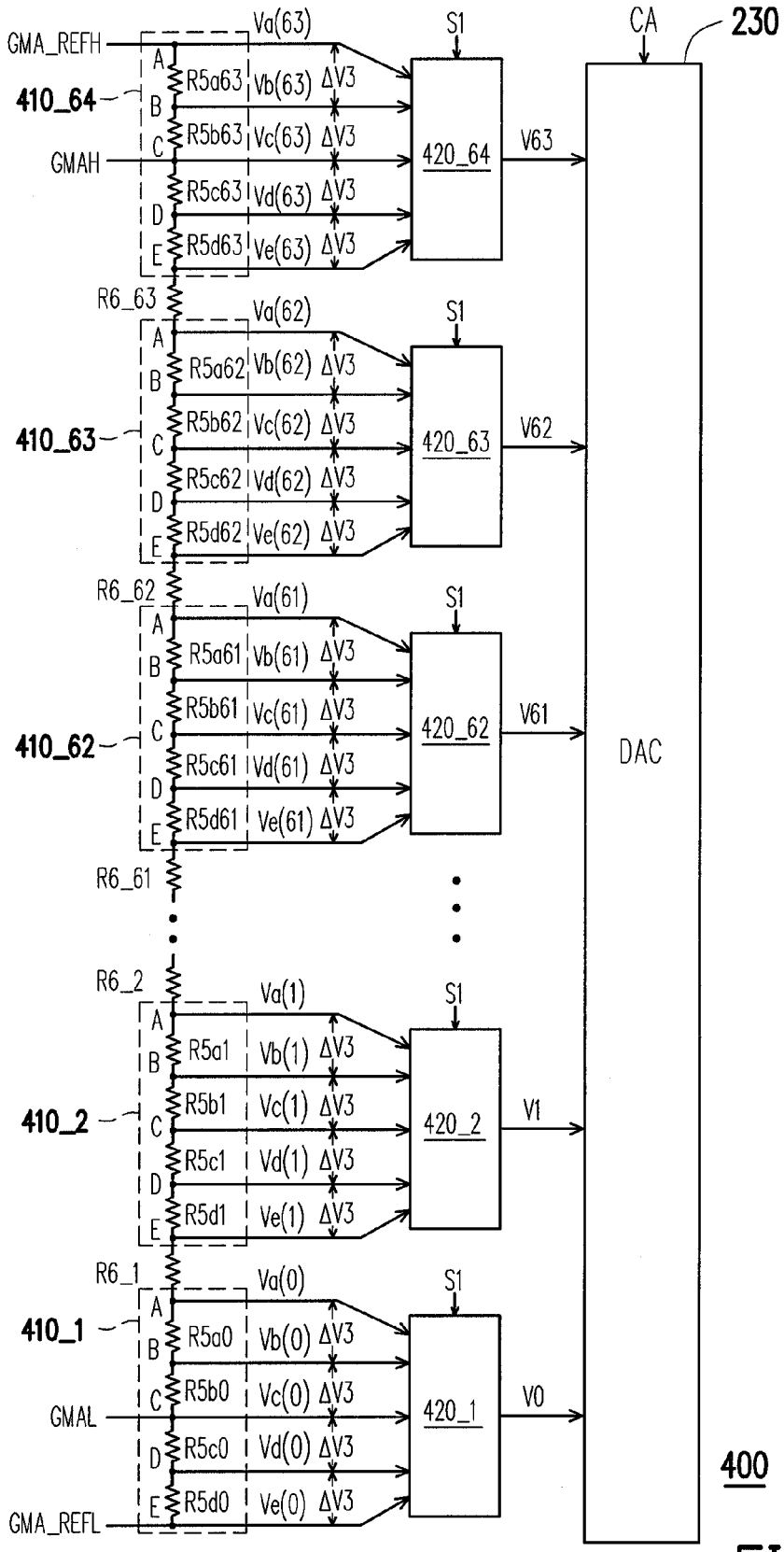
FIG. 4 is a circuit diagram illustrating a gamma voltage generation circuit according to a third embodiment of the present invention.

FIG. 4 is a circuit diagram illustrating a gamma voltage generation circuit according to a third embodiment of the present invention. Referring to FIG. 2 and FIG. 4, differences there between lie in resistor strings 410_1-410_64 and switches 420_1-420_64 of the gamma voltage generation circuit 400. The resistor strings 410_1-410_64 respectively have four first resistors (R5*a*0-R5*d*0), (R5*a*1-R5*d*1), . . . or (R5*a*63-R5*d*63), wherein a voltage drop between two ends of each of the first resistors R5*a*0-R5*a*63, R5*b*0-R5*b*63, R5*c*0-R5*c*63 and R5*d*0-R5*d*63 is substantially equal to a displacement voltage ΔV3. Each of the switches 420_1-420_64 is coupled to one of the ends A-E of a corresponding one of the resistor strings 410_1-410_64 according to the control signal S1, so as to respectively output gamma reference voltages Va(63)-Va(0), Vb(63)-Vb(0), Vc(63)-Vc(0), Vd(63)-Vd(0) or Ve(63)-Ve(0) to serve as the gamma voltages V63-V0, which is similar to that of the first embodiment, and detailed descriptions thereof are not repeated. In an embodiment of the present invention, the sum of the resistances of the resistors R5*c*63, R5*d*63, R6_63, R5*a*62 and R5*b*62 is equal to the resistance of the resistor CR63, the sum of the resistances of the resistors R5*c*62, R5*d*62, R6_62, R5*a*61 and R5*b*61 is equal to the resistance of the resistor CR62, . . . , and the sum of the resistances of the resistors R5*c*1, R5*d*1, R6_1, R5*a*0 and R5*b*0 is equal to the resistance of the resistor CR1.

If the gamma reference voltages Vc(63), Vc(62), . . . , Vc(1) and Vc(0) are taken as standard gamma voltages, the gamma reference voltages Vd(63), Vd(62), . . . , Vd(1) and Vd(0) are the gamma voltages displaced downwards for one displacement voltage ΔV3, the gamma reference voltages Ve(63), Ve(62), . . . , Ve(1) and Ve(0) are the gamma voltages displaced downwards for two displacement voltage ΔV3, the gamma reference voltages Vb(63), Vb(62), . . . , Vb(1) and Vb(0) are the gamma voltages displaced upwards for one displacement voltage ΔV3, and the gamma reference voltages Va(63), Va(62), . . . , Va(1) and Va(0) are the gamma voltages displaced upwards for two displacement voltage ΔV3. Relationships between the gamma reference voltages can be represented by following equations:

$$Va(n)=Vc(n)+2\Delta V3$$

$$Vb(n)=Vc(n)+\Delta V3$$

$$Vd(n)=Vc(n)-\Delta V3$$

$$Ve(n)=Vc(n)-2\Delta V3$$

Where n is an integer, and 63≥n≥0.

Accordingly, the switches 420_1-420_64 can be synchronously coupled to the ends A, ends B, ends C, ends D or ends E of the resistor strings 410_1-410_64 according to the control signal S1, so as to adjust the levels of the gamma voltages V63, V62, . . . , V1 and V0. Therefore, the gamma voltage generation circuit 200 provides five gamma curves, first one of which provides the gamma voltages Va(0)-Va(63), the second one provides the gamma voltages Vb(0)-Vb(63), the third one provides the gamma voltages Vc(0)-Vc(63), the fourth one provides the gamma voltages Vd(0)-Vd(63), and the fifth one provides the gamma voltages Ve(0)-Ve(63). In addition, when the level of the common voltages of different pixels (or sub-pixel) is different, the reference voltages of different levels can be outputted to tune the level of respective gamma voltages according to the control signal S1 so as to make the illumination of different pixels close or even the same for the same grey level. The phenomenon of color shift of the LCD panel would be avoided by applying proper gamma voltages to the subpixels of the LCD panel. For example, in an LCD panel that one pixel thereof has two sub-pixels applied by different common voltages, when driving the two sub-pixels of the same pixel, one of the sub-pixels may be driven by using one of the three gamma curves, and the other sub-pixel may be driven by using another one of the three gamma curves, such that the phenomenon of color shift of the LCD panel would be avoided.

It should be noticed that since the number of the resistors of the resistor string is different to that of the resistor string of the first embodiment, the resistances of the second resistors R6_1-R6_63 can be the same or different to that of the second resistors R2_1-R2_63 according to a design requirement. Moreover, the displacement voltage ΔV3 can also be the same or different to the displacement voltage ΔV according to actual application conditions.

In other embodiments, the number of the resistors of the resistor string can be adjust according to a design requirement, pins of the switch can be adjusted according to the above descriptions, and the resistances of the second resistors can be adjusted according to a predetermined gamma curve. Moreover, according to different circuit designs, the first level voltage GMAH and the second level voltage GMAL can be omitted.

In summary, the gamma voltage generation circuit of the present invention can selectively output a part of the gamma reference voltages to serve as the gamma voltages according to the control signal, and the adjacent output gamma voltages are adjusted to have the same displacement voltage, so that the levels of the gamma voltages can be synchronously displaced. Therefore, according to the synchronous displacement of the gamma voltages, pixels of different common voltage levels can present a same or similar display effect.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A gamma voltage generation circuit, comprising:

a plurality of resistor strings, each of the resistor strings having a plurality of first resistors connected in series, and each of ends of the first resistors providing a gamma reference voltage;

a plurality of second resistors, connected in series with the resistor strings; and a plurality of switches, wherein each of the switches is coupled to a corresponding one of the resistor strings, selects one of the gamma reference voltages provided by the ends of the first resistors of the corresponding one of the resistor strings according to a control signal, and outputs the selected gamma reference voltage.

2. The gamma voltage generation circuit as claimed in claim 1, wherein each of the second resistors is connected between two of the resistor strings.

3. The gamma voltage generation circuit as claimed in claim 1, wherein each of the switches is controlled by the control signal to be selectively connected to one of the ends of the first resistors of the corresponding one of the resistor strings.

4. The gamma voltage generation circuit as claimed in claim 1, wherein the resistances of the second resistors are different from each other.

5. The gamma voltage generation circuit as claimed in claim 1, further comprising a digital-to-analog converter, wherein the digital-to-analog converter outputs one of the gamma reference voltages selected by the switches according to a display code.

6. The gamma voltage generation circuit as claimed in claim 1, wherein a first end of a first one of the resistor strings is applied with a first reference voltage, a last end of a last one of the resistor strings is applied with a second reference voltage, and the first reference voltage is greater than the second reference voltage.

7. The gamma voltage generation circuit as claimed in claim 6, each of the gamma reference voltages provided by the ends of the first resistors is equal to or less than the first reference voltage, and each of the gamma reference voltages provided by the ends of the first resistors is equal to or greater than the second reference voltage.

* * * * *